US009639033B2

(12) United States Patent
Hirai

(10) Patent No.: US 9,639,033 B2
(45) Date of Patent: May 2, 2017

(54) IMAGE FORMING APPARATUS FOR CONTROLLING A TRANSFER VOLTAGE APPLIED TO TRANSFER A TONER IMAGE, AND METHOD AND NON-TRANSITORY STORAGE MEDIUM

(71) Applicant: KONICA MINOLTA, INC., Chiyoda-ku, Tokyo (JP)

(72) Inventor: Atsuto Hirai, Ikoma (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/004,688

(22) Filed: Jan. 22, 2016

(65) Prior Publication Data

US 2016/0216652 A1 Jul. 28, 2016

(30) Foreign Application Priority Data

Jan. 26, 2015 (JP) ..... 2015-012332

(51) Int. Cl.
*G03G 15/00* (2006.01)
*G03G 21/00* (2006.01)
*G03G 15/16* (2006.01)

(52) U.S. Cl.
CPC ..... *G03G 15/1675* (2013.01); *G03G 21/0005* (2013.01); *G03G 21/0094* (2013.01)

(58) Field of Classification Search
CPC ..... G03G 15/1665; G03G 21/0005; G03G 21/0094
USPC ..... 399/66, 346
See application file for complete search history.

(56) References Cited

U.S. PATENT DOCUMENTS 8,837,972 B2 9/2014 Nakade
2002/0048713 A1* 4/2002 Komoto ..... G03G 9/0827 430/124.1
2011/0222128 A1* 9/2011 Wada ..... G03G 15/0131 358/3.27

(Continued)

FOREIGN PATENT DOCUMENTS

JP 2000132003 A 5/2000
JP 2002258707 A 9/2002

(Continued)

OTHER PUBLICATIONS

Japanese Office Action (and English translation thereof) dated Jan. 24, 2017, issued in counterpart Japanese Application No. 2015-012332.

*Primary Examiner* — Billy Lactaoen
*Assistant Examiner* — Arlene Heredia Ocasio
(74) *Attorney, Agent, or Firm* — Holtz, Holtz & Volek PC

(57) ABSTRACT

An image forming apparatus includes: a latent image carrier; an image forming unit configured to form, on the latent image carrier, a toner image using a developer including a toner and a lubricating external additive charged with an opposite polarity to a charge polarity of the toner; a transfer device configured to electrostatically transfer, at a transfer position, the toner image formed by the image forming unit to a transfer medium; and a cleaning device configured to remove the toner remaining on the latent image carrier after passing the transfer position. The transfer device is configured to control a transfer voltage applied at the transfer position, based on an area ratio of an image to be printed.

24 Claims, 3 Drawing Sheets

(56) References Cited

U.S. PATENT DOCUMENTS

| | | | | |
|---|---|---|---|---|
| 2011/0268463 | A1* | 11/2011 | Kimura | G03G 21/0005 399/53 |
| 2012/0315055 | A1* | 12/2012 | Zaima | G03G 15/5041 399/49 |
| 2013/0136471 | A1* | 5/2013 | Lawton | G03G 15/0126 399/49 |
| 2013/0236201 | A1* | 9/2013 | Mizutani | G03G 15/1675 399/53 |
| 2014/0270819 | A1* | 9/2014 | Wada | G03G 15/553 399/29 |
| 2015/0037054 | A1* | 2/2015 | Nagata | G03G 15/5058 399/49 |
| 2015/0331357 | A1* | 11/2015 | Tsukamura | G03G 15/0848 399/53 |
| 2015/0338792 | A1* | 11/2015 | Nakamura | G03G 15/1665 399/66 |
| 2016/0291504 | A1* | 10/2016 | Maeyama | G03G 15/0806 |

FOREIGN PATENT DOCUMENTS

| | | | |
|---|---|---|---|
| JP | 2004029209 | A | 1/2004 |
| JP | 2009058732 | A | 3/2009 |
| JP | 2009271240 | A | 11/2009 |
| JP | 2012203097 | A | 10/2012 |
| JP | 2013033137 | A | 2/2013 |
| JP | 2014002268 | A | 1/2014 |

* cited by examiner

IMAGE FORMING APPARATUS FOR CONTROLLING A TRANSFER VOLTAGE APPLIED TO TRANSFER A TONER IMAGE, AND METHOD AND NON-TRANSITORY STORAGE MEDIUM

This application is based on Japanese Patent Application No. 2015-012332 filed with the Japan Patent Office on Jan. 26, 2015, the entire content of which is hereby incorporated by reference.

BACKGROUND OF THE INVENTION

Field of the Invention

The present disclosure relates to an image forming apparatus based on electrophotography, a method for controlling an image forming apparatus, and a non-transitory storage medium encoded with a computer readable program.

Description of the Related Art

In an image forming apparatus based on electrophotography, as means for removing residual toner such as untransferred toner or post-transfer residual toner on a latent image carrier, a cleaning device based on a blade cleaning system is known for example that has a flat-shaped cleaning blade formed of an elastic body and brought into contact with a surface of the latent image carrier to thereby remove the residual toner on the latent image carrier.

In recent years, the electrophotographic image forming apparatus has been required to have toner particles with a reduced particle size for the sake of enhancement of the image quality. As a method for obtaining such toner particles, a polymerization method such as emulsion polymerization or suspension polymerization method for example is used.

However, as the particle size of toner particles is reduced, the adhesion between toner particles and the latent image carrier increases, which makes it difficult to remove the residual toner on the latent image carrier. Particularly in the case where toner produced by the polymerization method, namely so-called polymerized toner is used, the shape of toner particles is close to a sphere. The toner particles thus roll on the latent image carrier to pass through the cleaning blade, namely a cleaning failure called "pass-through" is likely to occur. A resultant problem is therefore the increased difficulty in removing residual toner on the latent image carrier.

Moreover, if some toner particles pass through the blade, a toner aggregate with the toner particle at the core is formed on the latent image carrier, to generate a granular blank (granular noise) in a solid-image printed portion.

In order to address the quality problems such as "pass-through" or "granular noise," currently a lubricant is supplied onto the latent image carrier to reduce the adhesion between toner particles and the latent image carrier and, in this condition, cleaning is performed.

There are some methods for supplying the lubricant onto the latent image carrier, including a lubricant application system according to which a brush is brought into contact with a rod-shaped lubricant to scrape the lubricant and supply the lubricant to the surface of the latent image carrier, and an external-addition-to toner system according to which a toner containing a lubricating external additive is applied to form a toner image and the lubricant is thus supplied.

The external-addition-to-toner system is advantageous in terms of installation space and cost, since application devices such as lubricant rod and brush are unnecessary. However, regarding the external-addition-to-toner system, the lubricant is predominantly consumed when an image having a low area ratio is printed, resulting in decrease of the amount of the lubricant in a development device. The decrease of the amount of the lubricant in the development device causes the lubricant to be supplied unevenly to the surface of the latent image carrier, leaving a region where no lubricant is present. When the amount of the lubricant supplied per unit area decreases, the lubricant cannot be supplied enough to reduce the amount of the toner adhering to the latent image carrier to cause the above problems of the quality.

Regarding this, Japanese Laid-Open Patent Publication No. 2009-58732 discloses a system according to which a lubricant is applied onto an intermediate transfer medium, and a potential difference between the intermediate transfer medium and a photoreceptor causes the lubricant to be supplied onto the photoreceptor. At this time, the surface potential of the photoreceptor (transfer potential difference) is changed to control the amount of the lubricant supplied in the axial direction.

Japanese Laid-Open Patent Publication No. 2002-258707 discloses a cleaning system having a developer of the external-addition-to-toner type, a cleaning roller, and a blade. In accordance with the system, when a patch image is to be formed, the bias is changed so as not to collect the toner and the lubricant by the cleaning roller and the toner and the lubricant are caused to reach the blade.

Japanese Laid-Open Patent Publication No. 2000-132003 discloses a system according to which a zinc stearate (lubricant) supply mode is provided separately from an image forming mode and the development bias is changed in the supply mode.

SUMMARY OF THE INVENTION

When an image with a high area ratio is printed, the amount of the lubricant in the development device increases, and accordingly the lubricant on the latent image carrier increases. If the amount of the lubricant on the latent image carrier becomes excessively large, wear of the blade increases. Therefore, the amount of the lubricant on the latent image carrier should fall within an appropriate range.

It is therefore necessary to keep the amount of the lubricant on the latent image carrier within an appropriate range, depending on an image to be printed.

The present disclosure is given to provide a solution to the problems as described above, and provides an image forming apparatus capable of keeping an amount of a lubricant on a latent image carrier within an appropriate range depending on an image to be printed, a method for controlling an image forming apparatus, and a non-transitory storage medium encoded with a computer readable program.

To achieve at least one of the abovementioned objects, an image forming apparatus reflecting one aspect of the present invention comprises: a latent image carrier; an image forming unit configured to form, on the latent image carrier, a toner image using a developer including a toner and a lubricating external additive charged with an opposite polarity to a charge polarity of the toner; a transfer device configured to electrostatically transfer, at a transfer position, the toner image formed by the image forming unit to a transfer medium; and a cleaning device configured to remove the toner remaining on the latent image carrier after passing the transfer position. The transfer device is configured to control a transfer voltage applied at the transfer position, based on an area ratio of an image to be printed.

Preferably, the transfer device is configured to control the transfer voltage applied at the transfer position, based on the area ratio of an image to be printed and the number of sheets on which the image is to be printed.

Preferably, the transfer device is configured to control the transfer voltage for forming a toner image in a region other than an image region, based on the area ratio of an image to be printed and the number of sheets on which the image is to be printed.

Preferably, the transfer device is configured to change the transfer voltage for forming a toner image in an image region and the transfer voltage for forming a toner image in a region other than the image region, based on the area ratio of an image to be printed and the number of sheets on which the image is to be printed.

Preferably, the transfer device is configured to switch among a mode of controlling the transfer voltage for forming a toner image in an image region, a mode of controlling the transfer voltage for forming a toner image in a region other than the image region, and a mode of controlling the transfer voltage for forming a toner image in the image region and a toner image in a region other than the image region, based on the area ratio of an image to be printed and the number of sheets on which the image is to be printed.

Preferably, the transfer device is configured to control at least one of the transfer voltage for forming a toner image in an image region and the transfer voltage for forming a toner image in a region other than the image region, by referring to a transfer table recorded in advance, based on the area ratio of an image to be printed and the number of sheets on which the image is to be printed.

Preferably, the transfer device is configured to set the transfer voltage applied at the transfer position higher than a predetermined transfer voltage, when the area ratio of an image to be printed is lower than a predetermined ratio.

Preferably, the lubricating external additive has a particle size smaller than at least a particle size of the toner.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
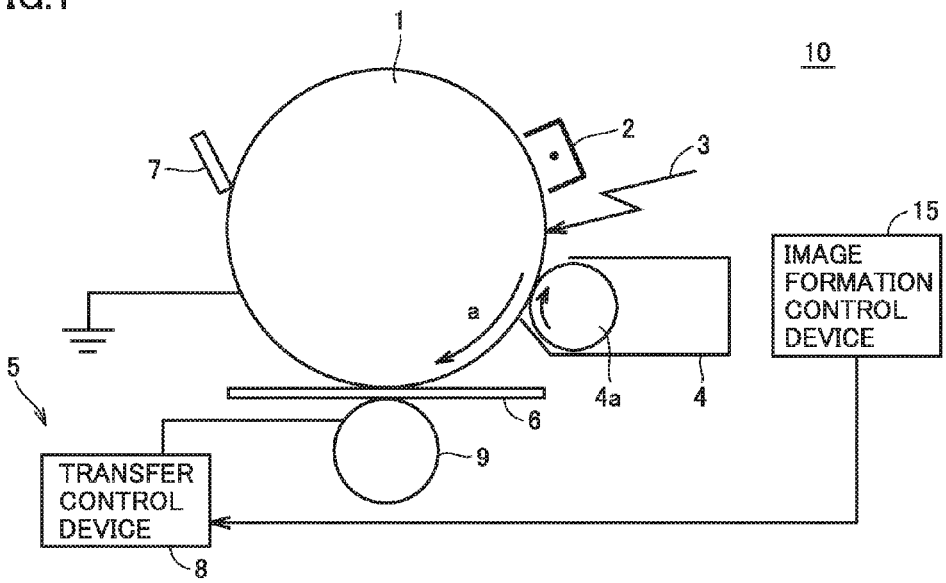
FIG. 1 is a diagram illustrating a configuration of an image forming apparatus 10 based on the present embodiment.

Embodiments will be described in detail with reference to the drawings. It should be noted that the same or corresponding parts in the drawings are denoted by the same reference characters, and a description thereof will not be repeated.

FIG. 1 is a diagram illustrating a configuration of an image forming apparatus 10 based on the present embodiment.

As shown in FIG. 1, image forming apparatus 10 includes a drum-shaped photoreceptor 1 which is a latent image carrier rotationally driven in the direction indicated by "a" in FIG. 1, a charging device 2 for uniformly charging the surface of photoreceptor 1, an exposure device 3 exposing the surface of photoreceptor 1 charged by charging device 2 to form an electrostatic latent image, a development device 4 making visible the electrostatic latent image formed by exposure device 3 by means of a developer including a toner and a lubricant, a transfer device 5 transferring, at a transfer position, the toner image formed on photoreceptor 1 to an intermediate transfer medium 6, and a cleaning device 7 removing the toner on photoreceptor 1 after passing the transfer position.

The toner image transferred to intermediate transfer medium 6 is transferred, at a secondary transfer position (not shown), to a recording material such as paper, thereafter conveyed to a fixing device, and fixed on the recording material.

Photoreceptor 1 is grounded for example, and formed of an organic photoreceptor which includes a drum-shaped metal base body for example having an outer peripheral surface on which formed a photoreceptor layer made of a resin containing an organic photoconductor. The resin forming the photoreceptor layer may for example be polycarbonate resin, silicone resin, polystyrene resin, acrylic resin, methacrylic resin, epoxy resin, polyurethane resin, vinyl chloride resin, melamine resin, or the like.

Charging device 2 uses a charger for example to charge photoreceptor 1 to a uniform potential. After this, exposure device 3 such as laser forms the electrostatic latent image on the surface of photoreceptor 1.

Development device 4 includes a development sleeve 4*a* disposed to face photoreceptor 1 with a development region interposed therebetween. To this development sleeve 4*a*, a DC development bias with the same polarity as the charge polarity of charging device 2, or a development bias which is an AC voltage on which superimposed a DC voltage with the same polarity as the charge polarity of charging device 2 is applied. Accordingly, reversal development of causing the toner to adhere to the electrostatic latent image formed by exposure device 3 is done.

Charging device 2, exposure device 3, and development device 4 constitute an image forming unit, and an image formation control device 15 controlling the image forming unit is further included.

The toner image formed on photoreceptor 1 by development device 4 is conveyed to the transfer position formed between the photoreceptor and transfer device 5.

At the transfer position, a voltage with the opposite polarity to the toner is applied by transfer device 5, and the toner image on photoreceptor 1 is transferred onto intermediate transfer medium 6.

Transfer device 5 includes a transfer roller 9 and a transfer control device 8 controlling a potential difference between transfer roller 9 and photoreceptor 1 to control the transfer voltage at the transfer position. Regarding the present example, the configuration in which photoreceptor 1 is grounded is described as an example. Alternatively, the potential of photoreceptor 1 may also be controlled by transfer control device 8.

It should be noted that transfer control device 8 operates in accordance with instructions from image formation control device 15. Specifically, in the case where an image with a low area ratio is to be printed, image formation control device 15 instructs transfer control device 8 to control the transfer voltage.

The toner which is not transferred onto intermediate transfer medium 6 at the transfer position and thus remains on photoreceptor 1 is transported to cleaning device 7 and collected by cleaning device 7.

Photoreceptor 1 with the toner on its surface collected by cleaning device 7 is charged again by charging device 2, the next electrostatic latent image is formed on photoreceptor 1, and a toner image is formed therefrom. This process is thus repeated.

For cleaning device 7, the blade cleaning system is commonly used by which a flat-shaped cleaning blade formed of an elastic body is brought into contact with photoreceptor 1. As to physical properties of the cleaning blade, the modulus of repulsion elasticity and the hardness of the cleaning blade can be designed appropriately by those skilled in the art so that they have appropriate values. By way of example, the modulus of repulsion elasticity at a temperature of 25° C. can be set to 10% to 80%. More preferably, the modulus may be set to 30% to 70%.

Moreover, the JIS-A hardness can be set to 20° to 90°. More preferably, the JIS-A hardness may be set to 60° to 80°.

In the case where the JIS-A hardness is smaller than 20°, the cleaning blade is too soft and therefore blade turn-up is more likely to occur. In contrast, in the case where the JIS-A hardness is larger than 90°, it is difficult for the blade to conform to fine projections and depressions of photoreceptor 1 or foreign matter, and therefore toner particles are more likely to "pass through."

The contact load of the cleaning blade on photoreceptor 1 can be set to 0.1 to 30 N/m. More preferably, the contact load may be set to 1 to 25 N/m.

In the case where the contact load is smaller than 0.1 N/m, the cleaning capability may be insufficient to cause dirt on an image. In contrast, in the case where the contact load is larger than 30 N/m, wear of photoreceptor 1 may increase to cause image fading or the like. For measurement of the load, a method according to which a leading edge of the cleaning blade is pressed against a balance to take a measurement, or a method according to which a sensor such as load cell may be disposed at the position where the leading edge of the cleaning blade contacts photoreceptor 1 to electrically take a measurement, for example, is used.

In the image forming apparatus in the present disclosure, the image forming unit forms a toner image on the latent image carrier using a developer including a toner and a lubricating external additive charged with an opposite polarity to a charge polarity of the toner, and transfer device 5 electrostatically transfers, at the transfer position, the formed toner image to a transfer medium. Then, cleaning device 7 removes residual toner on the latent image carrier after passing the transfer position. In the present example, transfer device 5 controls the transfer voltage applied at the transfer position, based on the area ratio of an image to be printed.

Moreover, the image forming apparatus in the present disclosure forms a toner image (patch image) in a region (region other than an image region) different from the ordinary image formation region (the image region) corresponding to an original image. Specifically, in a region between the image formation region and the following image formation region (inter-image region) or in a no-image formation region, a toner image (patch image) is formed. Image formation control device 15 of the image formation unit has a capability of controlling at least one of charging device 2, exposure device 3, and development device 4 to form a patch image.

The toner used for forming an ordinary toner image and the toner used for forming a patch image have the same composition and include at least a lubricating external additive. The lubricating external additive is not particularly limited and may be any of metal salt of fatty acid, silicone oil, fluorine-based resin, and the like. One of these additives may be used or a mixture of two or more of them may be used. In particular, metal salt of fatty acid may be used. Regarding the metal salt of fatty acid, straight-chain hydrocarbon may be used as the fatty acid. For example, myristic acid, palmitic acid, stearic acid, oleic acid, or the like may be used. Preferably stearic acid is used. As the metal, lithium, magnesium, calcium, strontium, zinc, cadmium, aluminum, cerium, titanium, iron, or the like may be used. Among them, zinc stearate, magnesium stearate, aluminum stearate, iron stearate, or the like may be used. In particular, zinc stearate is preferred.

Next, an evaluation device for lubricant amount control will be described.

Figure 2A:
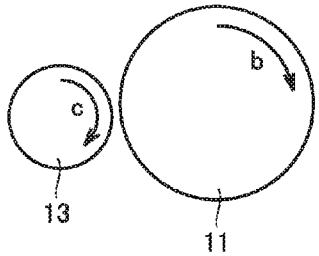
FIGS. 2A and 2B are diagrams illustrating an evaluation device for controlling the amount of a lubricant at a transfer position (transfer portion).
Figure 2B:
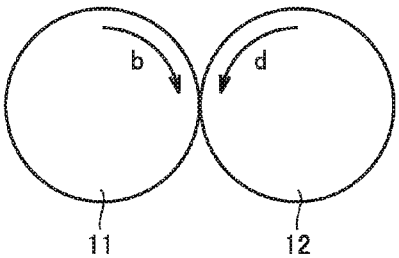

FIGS. 2A and 2B are diagrams illustrating an evaluation device for controlling the amount of a lubricant at a transfer position (transfer portion).

Referring to FIG. 2A, a description will be given of the present example where a development roller 13 of ϕ30 mm is used. The circumferential surface of an aluminum sleeve which forms development roller 13 carries a developer of 250 g/m. A photoreceptor 11 is disposed to face development roller 13 at a distance of 250 μm from the development roller.

Photoreceptor 11 is a photoreceptor formed of an aluminum cylindrical body of ϕ100 mm and a length of 100 mm and a photoreceptor layer provided on the surface of the cylindrical body, made of polycarbonate resin, and having a thickness of 25 μm, and photoreceptor 11 is connected to GND.

To development roller 13, an AC voltage with a frequency of 6000 Hz, an amplitude of 800 V, and an offset of −450 V is applied. Then, in this condition, development roller 13 is rotated in the "c" direction indicated in FIG. 2A at 600 mm/sec. Photoreceptor 11 is thereafter caused to make one rotation in the "b" direction indicated in FIG. 2A at 400 mm/sec.

Accordingly, a toner layer of 5 g/m$^2$ is formed on photoreceptor 11.

Next, referring to FIG. 2B, development roller 13 is separated from photoreceptor 11, and a rubber roller 12 having a surface on which an electrically conductive rubber layer is provided is brought into contact with photoreceptor 11. In this condition, an arbitrary voltage is applied to a core metal of rubber roller 12. Then, in this condition, photoreceptor 11 is caused to make one rotation in the "b" direction indicated in FIG. 2B at 400 mm/sec.

Rubber roller 12 is in contact with photoreceptor 11 and therefore follows the movement of photoreceptor 11. After photoreceptor 11 makes one rotation, the toner image on photoreceptor 11 has been transferred onto rubber roller 12.

The voltage applied to rubber roller 12 was varied to measure the amount of the toner and the amount of the lubricant remaining on photoreceptor 11 at that time.

Moreover, from the amount of the toner formed on photoreceptor 11 and the amount of the toner remaining on photoreceptor 11 after transfer, the transfer efficiency was determined.

The transfer efficiency was calculated based on the following formula for example:

transfer efficiency=(1−amount of post-transfer residual toner on photoreceptor 11/amount of toner on photoreceptor 11 after development)×100(%).

The amount of the lubricant was calculated based on the ratio of zinc to zinc stearate that is determined by means of an x-ray photoelectron spectroscopic analysis device.

Figure 3:
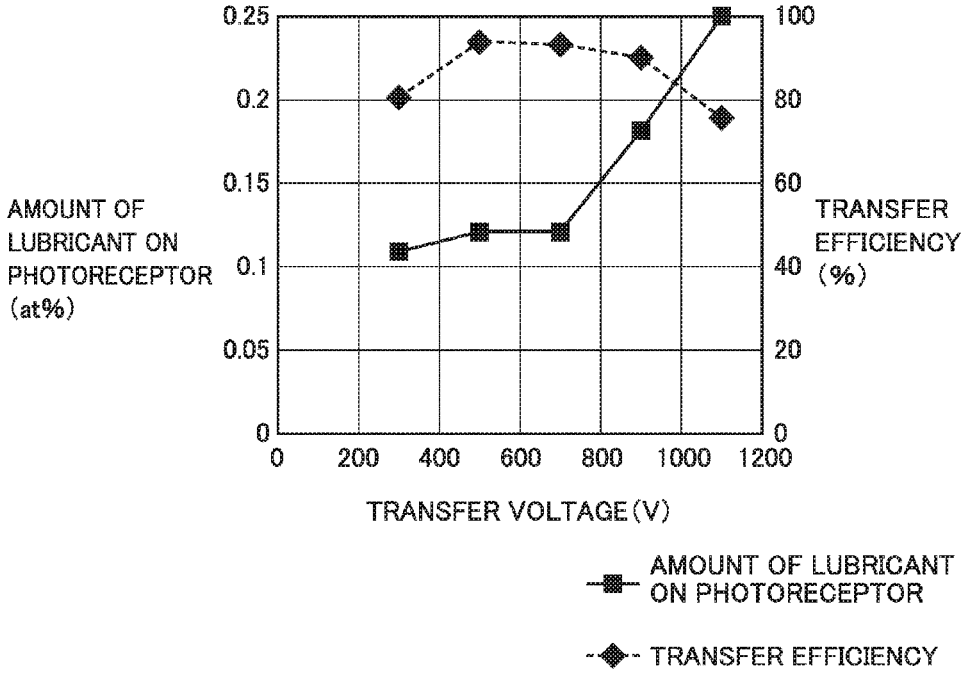
FIG. 3 is a diagram illustrating the transfer efficiency and the amount of a lubricant on a photoreceptor, with respect to the transfer voltage.

FIG. 3 is a diagram illustrating the transfer efficiency and the amount of the lubricant on the photoreceptor, with respect to the transfer voltage.

In FIG. 3, data of the amount of the lubricant (solid line) on the photoreceptor with respect to the transfer voltage, and data of the transfer efficiency (dotted line) with respect to the transfer voltage are plotted.

As is apparent from FIG. 3, when the transfer voltage exceeds a certain value, the amount of the lubricant remaining on photoreceptor 11 increases. However, when the transfer voltage is excessively increased, the transfer efficiency drops.

Thus, the transfer voltage can be increased to increase the amount of the lubricant supplied onto the photoreceptor.

However, when the transfer voltage is excessively increased, the transfer efficiency decreases. Since the decrease of the transfer efficiency has an influence on the image, the transfer voltage which can be set during image formation has an upper limit, and increase of the amount of the lubricant applied to the photoreceptor is also restricted.

In contrast, when a patch image is formed in a region other than the image region, the image quality and the transfer efficiency are not restricted, and therefore the transfer voltage can be increased to increase the amount of the lubricant supplied to the photoreceptor.

In accordance with the configuration of the image forming apparatus shown in FIG. 1, the photoreceptor, the development device, the transfer device, the toner, and the cleaning blade for example were set in the following way.

(1) Photoreceptor 1

As photoreceptor 1, a drum-shaped organic photoreceptor was used. Specifically, on the outer circumferential surface of a drum-shaped metal base body made of aluminum, a photoreceptor layer made of polycarbonate resin and having a thickness of 25 μm was formed. Photoreceptor 1 was rotated at 400 mm/sec.

(2) Development Device 4

Development device 4 had development sleeve 4*a* rotationally driven at a linear velocity of 600 mm/min. To this development sleeve 4*a*, a bias voltage of the same polarity as the surface potential of photoreceptor 1 was applied, and a two-component developer was used to perform reversal development.

(3) Transfer Device 5

As intermediate transfer medium 6, an endless belt made of polyimide resin to which electrical conductivity was given was used, and transfer roller 9 was provided which was pressed against photoreceptor 1 with the belt interposed therebetween and to which a voltage with the opposite polarity to the charge polarity of the toner was applied.

(4) Cleaning Device 7

As the cleaning blade of cleaning device 7, a cleaning blade was used that was made of urethane rubber and had a modulus of repulsion elasticity of 50% (25° C.), a JIS-A hardness of 70°, a thickness of 2.00 mm, a free length of 10 mm, and a width of 324 mm. The cleaning blade was set so that the contact load on photoreceptor 1 was 20 N/m and the contact angle was 15°.

(5) Toner

The toner as a component of a two-component developer was made up of toner particles produced by emulsion polymerization and having a volume average particle size of 6.5 μm, and negatively charged. To the toner particles, 0.2 parts of zinc stearate was added as a lubricating external additive, with respect to the toner.

Under the above-described conditions, surface potential Vo of photoreceptor 1 in a non-exposed region was set to −750 V, and surface potential Vi of photoreceptor 1 in an exposed region was set to −100 V. To development sleeve 4*a*, a development bias with a frequency of 6000 Hz, an amplitude of 800 V, and a DC component of −550 V was applied. The above-described image forming apparatus was used to perform an actual printing test in which 50,000 sheets were printed in a low-temperature and low-moisture environment (temperature 10° C., relative humidity 20%), to examine occurrence of granular noise.

Figure 4:
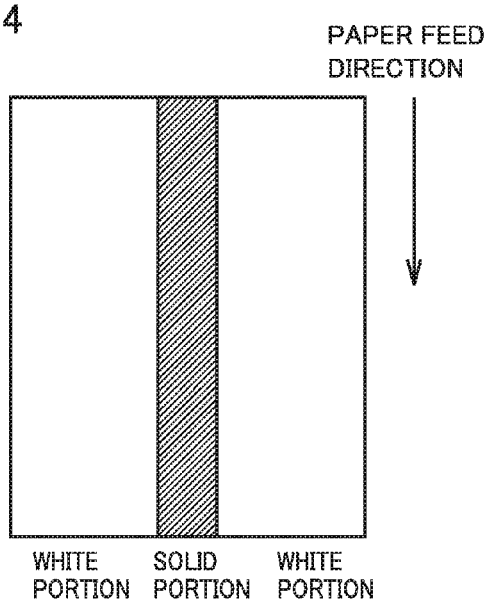
FIG. 4 is a diagram illustrating an image pattern.

FIG. 4 is a diagram illustrating an image pattern.

As shown in FIG. 4, a portrait strip chart where granular noise was likely to occur was used as an image pattern.

An evaluation was made with a rating of "0" given to non-occurrence of granular noise and a rating of "X" given to occurrence of granular noise.

Although the area ratio should essentially represent the area of a solid portion in an original (image portion), a white portion between an image formation region and the following image formation region affects the amount of the lubricant in the development device and therefore the area ratio is herein the area ratio with respect to an area including the inter-image region between the image formation regions. The area of the solid portion can be calculated for example by counting the number of dots in an original (original data).

In the present example, the area of the solid portion is defined with respect to an area including an inter-image region between an image formation region and the following image formation region for example. Specifically, the area of the solid portion is calculated relative to the area having a total length of 470 mm in the paper feed direction which is the sum of the height of A3 (420 mm) and the height of an inter-image region of 50 mm, and the dimension in the axial direction of the photoreceptor of 330 mm.

COMPARATIVE EXAMPLE 1

For Comparative Example 1, an image with an area ratio of 1% was formed in an image formation region, and the transfer voltage was set to 500 V. An evaluation was made with the area ratio varied. The results are shown in Table 1.

TABLE 1

| (A) area ratio in image formation region: 1% | | |
|---|---|---|
| | | area ratio of patch image 0% total area ratio of image portion and patch portion 1% |
| number of printed sheets (sheets) | 1000 | ○ |
| | 2000 | X |
| | 3000 | X |
| | 4000 | |
| | 5000 | |
| | 10000 | |
| | 50000 | |

TABLE 1-continued

| (B) area ratio in image formation region: 3% | | |
|---|---|---|
| | | area ratio of patch image 0% total area ratio of image portion and patch portion 3% |
| number of printed sheets (sheets) | 1000 | ○ |
| | 2000 | ○ |
| | 3000 | X |
| | 4000 | |
| | 5000 | |
| | 10000 | |
| | 50000 | |

As shown in Table 1 (A), in the case of the image with an area ratio of 1%, granular noise occurred when the number of printed sheets reached 2,000.

Moreover, an image with an area ratio of 3% was formed in an image formation region, and the transfer voltage was set to 500 V.

As shown in Table 1 (B), in the case of the image with an area ratio of 3%, granular noise occurred when the number of printed sheets reached 3,000.

In the case of a toner with external additives, the toner is not consumed while only the lubricant adheres onto photoreceptor 1 and consumed in a white portion. In the case where the lubricant has a small particle size and adheres to the toner, the lubricant is consumed together with the toner in a solid portion. Therefore, the amount of the lubricant in the development device during image printing or after image printing varies depending on the ratio between a white portion and a solid portion in an image (image area ratio). In the case of an image with a low area ratio where a white portion is relatively large, the lubricant is consumed in the white portion while the amount of the toner newly supplied is small. Therefore, the amount of the lubricant in the development device decreases and consequently the amount of the lubricant supplied onto photoreceptor 1 decreases. In the case of an image where a solid portion is relatively large, a larger amount of the toner is consumed and accordingly the lubricant is also consumed. Then, toner is newly supplied and accordingly the lubricant is also supplied. Therefore, there should be a small decrease of the amount of the lubricant in the development device. Thus, in the case where an image with a lower area ratio is printed, there is a larger decrease of the amount of the lubricant supplied onto the photoreceptor and accordingly granular noise is more likely to occur.

EXAMPLE 1

For Example 1, an image with an area ratio of 1% was formed in an image formation region, and the transfer voltage was set to 700 V. An evaluation was made with the area ratio varied. The results are shown in Table 2.

TABLE 2

| (A) area ratio in image formation region: 1% | | |
|---|---|---|
| | | area ratio of patch image 0% total area ratio of image portion and patch portion 1% |
| number of printed sheets (sheets) | 1000 | ○ |
| | 2000 | ○ |
| | 3000 | ○ |
| | 4000 | X |
| | 5000 | |
| | 10000 | |
| | 50000 | |

| (B) area ratio in image formation region: 3% | | |
|---|---|---|
| | | area ratio of patch image 0% total area ratio of image portion and patch portion 3% |
| number of printed sheets (sheets) | 1000 | ○ |
| | 2000 | ○ |
| | 3000 | ○ |
| | 4000 | ○ |
| | 5000 | ○ |
| | 10000 | ○ |
| | 50000 | X |

As shown in Table 2 (A), in the case of the image with an area ratio of 1%, granular noise occurred when the number of printed sheets reached 4,000.

Moreover, an image with an area ratio of 3% was formed in an image formation region, and the transfer voltage was set to 700 V.

As shown in Table 2 (B), in the case of the image with an area ratio of 3%, granular noise occurred when the number of printed sheets reached 50,000.

As described above with reference to FIG. 3, the transfer voltage which is set to a high voltage, namely 700 V causes an increase of the amount of the lubricant separated from the toner at the transfer position and accordingly remaining on photoreceptor 1.

Therefore, in the case where an image with a low area ratio is to be printed, image formation control device 15 can instruct transfer control device 8 to set the transfer voltage to a high voltage, which is 700 V in the present example, to thereby increase the lower limit of the number of printed sheets which is reached when granular noise occurs. Namely occurrence of granular noise can be suppressed.

The above description of the present example is given about the case where an image with a low area ratio formed in an image formation region is an image with a predetermined area ratio or less (3% or less in the present example). However, the area ratio is merely an example and the predetermined area ratio varies depending on the type and the amount of the added lubricant. Therefore, the design of the predetermined area ratio can appropriately be changed by those skilled in the art. Likewise, the above description is given about the case where the transfer voltage is set to a voltage (700 V for example) higher than a predetermined voltage (500 V). However, the voltage value also varies depending on conditions. Therefore, the design of the voltage value can also be changed appropriately by those skilled in the art. This is applied as well to the following Examples.

COMPARATIVE EXAMPLE 2

In the case where a patch image is formed in an inter-image region between an image formation region and the following image formation region, the toner is consumed in the patch image and consequently the concentration of the toner in the development device decreases and then toner is newly supplied. As the toner is newly supplied, the lubricant is also supplied together with the toner. Therefore, the amount of the lubricant in the development device is maintained and decrease of the amount of the lubricant supplied onto the photoreceptor can be prevented. As a result, occurrence of granular noise can be prevented.

Figure 5:
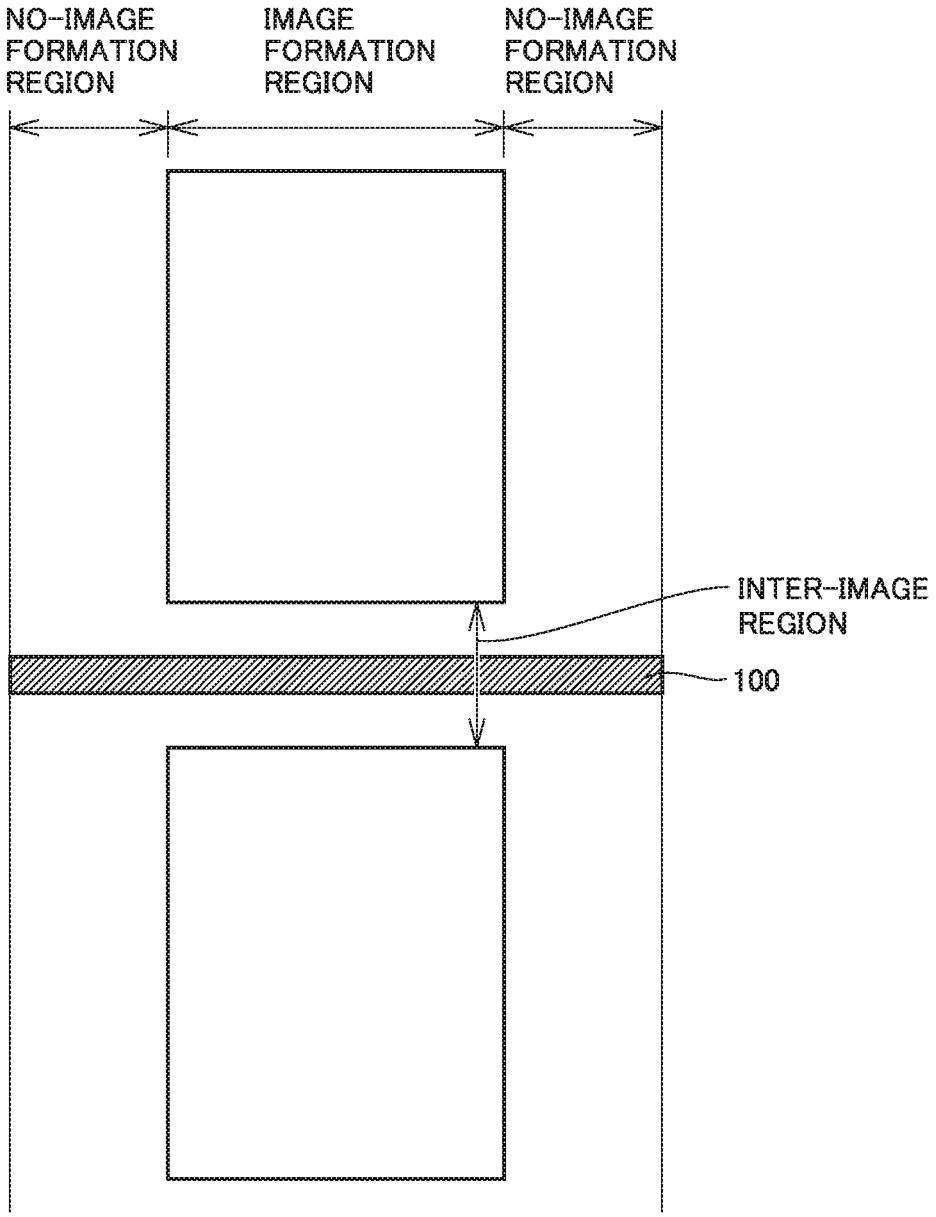
FIG. 5 is a diagram illustrating formation of a patch image according to an embodiment.

FIG. 5 is a diagram illustrating formation of a patch image according to an embodiment.

As shown in FIG. 5, in an inter-image region between an image formation region and the following image formation region, a patch image 100 is formed. The two opposite margins of the image formation region are provided as no-image formation regions. In these regions as well, the patch image is formed in the shape of a lateral strip.

For formation of the patch image, any of the following systems can be used: (1) a system according to which charging of photoreceptor 1 by charging device 2 is temporarily stopped and the toner is caused to adhere to the whole non-charged image formation region to thereby form a so-called solid image; (2) a system according to which light is selectively applied by exposure device 3 to a region where a patch image is to be formed on the surface of photoreceptor 1 uniformly charged by charging device 2, and the toner is caused to adhere to the exposed region to thereby form a solid image; and (3) a system according to which the development bias applied to development sleeve 4*a* of development device 4 is temporarily increased to cause the toner to adhere and thereby form a solid image. Regarding the present example, a description will be given of the case where the patch image is formed in accordance with the system of (2).

The patch image to be formed on photoreceptor 1 is preferably at least identical to or larger than, in the axial direction of photoreceptor 1, an image formation region in the ordinary image formation process.

In accordance with this system, an image with an area ratio of 1% was formed in an image formation region, and a patch image was printed with its area ratio varied, to examine the area ratio of a required patch image that does not cause granular noise. The results are shown in Table 3.

TABLE 3

| area ratio in image formation region: 1% | | | | | | | |
|---|---|---|---|---|---|---|---|
| | | area ratio of patch image | | | | | |
| | | 0% | 1% | 2% | 3% | 4% | 5% |
| | | total area ratio of image portion and patch portion | | | | | |
| | | 1% | 2% | 3% | 4% | 5% | 6% |
| number of printed sheets (sheets) | 1000 | ○ | ○ | ○ | ○ | ○ | ○ |
| | 2000 | X | ○ | ○ | ○ | ○ | ○ |
| | 3000 | X | X | X | ○ | ○ | ○ |
| | 4000 | | | | X | ○ | ○ |
| | 5000 | | | | | X | ○ |
| | 10000 | | | | | | ○ |
| | 50000 | | | | | | ○ |

As the area ratio of the patch image was increased, the lower limit of the number of printed sheets which was reached when granular noise occurs increased. In the case of the area ratio of the patch image of 5%, granular noise did not occur even after 50,000 sheets had been printed.

Moreover, in an image formation region, an image with an area ratio of 3% was formed, and a patch image was printed with its area ratio varied, to examine the area ratio of a required patch image that does not cause granular noise. The results are shown in Table 4.

TABLE 4

| area ratio in image formation region: 3% | | | | | |
|---|---|---|---|---|---|
| | | area ratio of patch image | | | |
| | | 0% | 1% | 2% | 3% |
| | | total area ratio of image portion and patch portion | | | |
| | | 3% | 4% | 5% | 6% |
| number of printed sheets (sheets) | 1000 | ○ | ○ | ○ | ○ |
| | 2000 | ○ | ○ | ○ | ○ |
| | 3000 | X | ○ | ○ | ○ |
| | 4000 | | X | ○ | ○ |
| | 5000 | | | X | ○ |
| | 10000 | | | | ○ |
| | 50000 | | | | ○ |

As the area ratio of the patch image was increased and set to 3%, granular noise did not occur even after 50,000 sheets had been printed.

Moreover, in an image formation region, an image with an area ratio of 6% was formed, and a patch image was printed with its area ratio varied, to examine the area ratio of a required patch image that does not cause granular noise. The results are shown in Table 5.

TABLE 5

| area ratio in image formation region: 6% | | | |
|---|---|---|---|
| | | area ratio of patch image | |
| | | 0% | 3% |
| | | total area ratio of image portion and patch portion | |
| | | 6% | 9% |
| number of printed sheets (sheets) | 1000 | ○ | ○ |
| | 2000 | ○ | ○ |
| | 3000 | ○ | ○ |
| | 4000 | ○ | ○ |
| | 5000 | ○ | ○ |
| | 10000 | ○ | ○ |
| | 50000 | ○ | ○ |

In the case where an image with an area ratio of 6% or more was formed in the image portion, it was unnecessary to form a patch image between images and no granular noise occurred.

Thus, it is seen from the above results that in the case where the image formed in the image formation region and the patch image have an area ratio of 6% or more under this condition, no granular noise occurs.

In other words, in the case where the image in the image formation region has a low area ratio, it is necessary to form a patch image between image formation regions so that the area ratio is 6%.

Regarding the present example, it can be assumed that a minimum amount of the lubricant that causes no granular noise can be ensured when the total area ratio of an image formed in an image formation region and a patch image formed between image formation regions is 6%.

Specifically, a description is given here using A3 as an example that is mentioned with reference to FIG. 4. In order to form a patch image with an area ratio of 5% in an inter-image region, the patch image in the form of a lateral strip of 24 mm in the paper feed direction may be formed. In the case where the area ratio of an image in an image formation region is 3%, a patch image with an area ratio of 3% may be formed in an inter-image region and in this case, the patch image in the shape of a lateral strip of 16 mm may be formed. In the case where the area ratio of an image in an image formation region is 6% or more, it is unnecessary to form a patch image between an image formation region and the following image formation region.

EXAMPLE 2

For Example 2, an image with an area ratio of 1% was formed in an image formation region, and the transfer voltage was set to 700 V. An evaluation was made with the area ratio of the patch image varied. The results are shown in Table 6.

TABLE 6

| area ratio in image formation region: 1% | | | | | |
|---|---|---|---|---|---|
| | | area ratio of patch image | | | |
| | | 0% | 1% | 2% | 3% |
| | | total area ratio of image portion and patch portion | | | |
| | | 1% | 2% | 3% | 4% |
| number of printed sheets (sheets) | 1000 | ○ | ○ | ○ | ○ |
| | 2000 | ○ | ○ | ○ | ○ |
| | 3000 | ○ | ○ | ○ | ○ |
| | 4000 | X | ○ | ○ | ○ |
| | 5000 | | X | ○ | ○ |
| | 10000 | | | ○ | ○ |
| | 50000 | | | X | ○ |

As shown in Table 6, in the case where a patch image with an area ratio of 3% was formed, no granular noise occurred even after 50,000 sheets had been printed. As compared with the case where the transfer voltage is 500 V as described above regarding Comparative Example 2, a reduction corresponding to a patch image with an area ratio of 2% can be made.

Moreover, an image with an area ratio of 3% was formed in an image formation region, and the transfer voltage was set to 700 V. An evaluation was made with the area ratio of the patch image varied. The results are shown in Table 7.

TABLE 7

| area ratio in image formation region: 3% | | | | | |
|---|---|---|---|---|---|
| | | area ratio of patch image | | | |
| | | 0% | 1% | 2% | 3% |
| | | total area ratio of image portion and patch portion | | | |
| | | 3% | 4% | 5% | 6% |
| number of printed sheets | 1000 | ○ | ○ | ○ | ○ |
| | 2000 | ○ | ○ | ○ | ○ |
| | 3000 | ○ | ○ | ○ | ○ |

TABLE 7-continued

| area ratio in image formation region: 3% | | | | | |
|---|---|---|---|---|---|
| | | area ratio of patch image | | | |
| | | 0% | 1% | 2% | 3% |
| | | total area ratio of image portion and patch portion | | | |
| | | 3% | 4% | 5% | 6% |
| (sheets) | 4000 | ○ | ○ | ○ | ○ |
| | 5000 | ○ | ○ | ○ | ○ |
| | 10000 | ○ | ○ | ○ | ○ |
| | 50000 | X | ○ | ○ | ○ |

As shown in Table 7, in the case where a patch image with an area ratio of 1% was formed, no granular noise occurred even after 50,000 sheets had been printed. As compared with the case where the transfer voltage is 500 V as described above regarding Comparative Example 2, a reduction corresponding to a patch image with an area ratio of 2% can be made.

In the case where a patch image with an area ratio of 2% is printed on 50,000 sheets, 780 g of toner are consumed, for example. Thus, the transfer voltage can be set to 700 V to reduce the toner by 780 g.

Accordingly, in the case where an image having a low area ratio is to be printed, the image formation control device can cause a patch image to be formed and the image formation control device can instruct transfer control device 8 to set the transfer voltage to a high voltage, which is 700 V in the present example, to thereby increase the lower limit of the number of printed sheets which is reached when granular noise occurs. Namely occurrence of granular noise can be suppressed.

EXAMPLE 3

The increased transfer voltage when an image is formed may lead to decrease of the transfer efficiency or degradation of the image quality.

In view of this, for Example 3, the transfer voltage in a transfer process for forming a patch image is set high.

For Example 3, an image with an area ratio of 1% was formed in an image formation region, and the transfer voltage was set to 500 V. The transfer voltage for forming a patch image was set to 900 V. An evaluation was made with the area ratio of the patch image varied. The results are shown in Table 8.

TABLE 8

| area ratio in image formation region: 1% | | | | | |
|---|---|---|---|---|---|
| | | area ratio of patch image | | | |
| | | 0% | 1% | 2% | 3% |
| | | total area ratio of image portion and patch portion | | | |
| | | 1% | 2% | 3% | 4% |
| number of printed sheets (sheets) | 1000 | ○ | ○ | ○ | ○ |
| | 2000 | X | ○ | ○ | ○ |
| | 3000 | X | ○ | ○ | ○ |
| | 4000 | | ○ | ○ | ○ |
| | 5000 | | ○ | ○ | ○ |
| | 10000 | | X | ○ | ○ |
| | 50000 | | X | ○ | ○ |

As shown in FIG. 3, when the transfer voltage was set to 900 V, the amount of the lubricant separated from the toner at the transfer position and accordingly remaining on the photoreceptor further increased. Although the transfer voltage set to 900 V may lower the transfer efficiency and degrade the image quality, this transfer voltage does not adversely affect formation of a patch image.

As shown in Table 8, in the case where a patch image with an area ratio of 2% was formed, no granular noise occurred. As compared with the case where the transfer voltage for forming a patch image is 500 V as described above regarding Comparative Example 2, a reduction corresponding to a patch image with an area ratio of 3% can be made.

In the case where a patch image with an area ratio of 3% is printed on 50,000 sheets, 1200 g of toner are consumed, for example. Thus, the transfer voltage can be set to 900 V to reduce the toner by 1200 g.

Moreover, an image with an area ratio of 3% was formed in an image formation region, and the transfer voltage was set to 900 V. An evaluation was made with the area ratio of the patch image varied. The results are shown in Table 9.

TABLE 9

| area ratio in image formation region: 3% | | | | | |
|---|---|---|---|---|---|
| | | area ratio of patch image | | | |
| | | 0% | 1% | 2% | 3% |
| | | total area ratio of image portion and patch portion | | | |
| | | 3% | 4% | 5% | 6% |
| number of printed sheets (sheets) | 1000 | ○ | ○ | ○ | ○ |
| | 2000 | ○ | ○ | ○ | ○ |
| | 3000 | X | ○ | ○ | ○ |
| | 4000 | | ○ | ○ | ○ |
| | 5000 | | ○ | ○ | ○ |
| | 10000 | | ○ | ○ | ○ |
| | 50000 | | ○ | ○ | ○ |

As shown in Table 9, in the case where a patch image with an area ratio of 1% was formed, no granular noise occurred even after 50,000 sheets had been printed. As compared with the case where the transfer voltage is 500 V as described above regarding Comparative Example 2, a reduction corresponding to a patch image with an area ratio of 2% can be made.

In the case where a patch image with an area ratio of 2% is printed on 50,000 sheets, 780 g of toner are consumed, for example. Thus, the transfer voltage can be set to 900 V to reduce the toner by 780 g.

Accordingly, in the case where an image having a low area ratio is to be printed, the image formation control device can cause a patch image to be formed and the image formation control device can instruct transfer control device 8 to set the transfer voltage for transferring the patch image to a high voltage, which is 900 V in the present example, to thereby suppress occurrence of granular noise.

EXAMPLE 4

For Example 4, an image with an area ratio of 1% was formed in an image formation region and the transfer voltage was set to 700 V, and the transfer voltage for forming a patch image was set to 900 V. An evaluation was made with the area ratio of the patch image varied. The results are shown in Table 10.

TABLE 10

| area ratio in image formation region: 1% | | | | | |
|---|---|---|---|---|---|
| | | area ratio of patch image | | | |
| | | 0% | 1% | 2% | 3% |
| | | total area ratio of image portion and patch portion | | | |
| | | 1% | 2% | 3% | 4% |
| number of printed sheets (sheets) | 1000 | ○ | ○ | ○ | ○ |
| | 2000 | ○ | ○ | ○ | ○ |
| | 3000 | ○ | ○ | ○ | ○ |
| | 4000 | X | ○ | ○ | ○ |
| | 5000 | | ○ | ○ | ○ |
| | 10000 | | ○ | ○ | ○ |
| | 50000 | | X | ○ | ○ |

As shown in Table 10, in the case where a patch image with an area ratio of 2% was formed, no granular noise occurred even after 50,000 sheets had been printed.

Moreover, an image with an area ratio of 3% was formed in an image formation region and the transfer voltage was set to 700 V, and the transfer voltage for forming a patch image was set to 900 V. An evaluation was made with the area ratio of the patch image varied. The results are shown in Table 11.

TABLE 11

| area ratio in image formation region: 3% | | | | | |
|---|---|---|---|---|---|
| | | area ratio of patch image | | | |
| | | 0% | 1% | 2% | 3% |
| | | total area ratio of image portion and patch portion | | | |
| | | 3% | 4% | 5% | 6% |
| number of printed sheets (sheets) | 1000 | ○ | ○ | ○ | ○ |
| | 2000 | ○ | ○ | ○ | ○ |
| | 3000 | ○ | ○ | ○ | ○ |
| | 4000 | ○ | ○ | ○ | ○ |
| | 5000 | ○ | ○ | ○ | ○ |
| | 10000 | ○ | ○ | ○ | ○ |
| | 50000 | X | ○ | ○ | ○ |

As shown in Table 11, in the case where a patch image with an area ratio of 1% was formed, no granular noise occurred even after 50,000 sheets had been printed.

It is seen from the above that the contribution of the area ratio of the patch image is large while the influence of the image formation region is small. In contrast, for up to 3,000 printed sheets, it is unnecessary to form a patch image even when the area ratio of an image in an image formation region is small, and granular noise is less likely to occur as compared with Example 3.

Therefore, in the case where an image having a low area ratio is to be printed, image formation control device 15 causes a patch image to be formed and image formation control device 15 instructs transfer control device 8 to set the transfer voltage for transferring the image formed in the image formation region to a high voltage, which is 700 V in the present example. Further, the transfer voltage for transferring the patch image is set to a high voltage, which is 900 V in the present example. Accordingly, occurrence of granular noise can be suppressed.

EXAMPLE 5

As to Example 5, a description will be given of a system for changing the transfer voltage for forming an image and the transfer voltage for forming a patch image, depending on the area ratio in an image formation region and the number of sheets to be printed.

Based on the area ratio of an image to be printed and the number of sheets on which the image is to be printed, a switch is made among a mode of controlling the transfer voltage for forming the image in an image formation region, a mode of controlling the transfer voltage for forming a patch image, and a mode of controlling the transfer voltage for forming the image in the image formation region and a patch image.

The following description is of the case where an image with an area ratio of 1% is formed in an image formation region.

In the case where the number of sheets to be printed is 1,000 or less, there is no concern about granular noise. Therefore, the transfer voltage for the image formation region is set to a standard voltage of 500 V and no patch image is formed in an inter-image region.

In the case where the number of sheets to be printed is 1,001 or more and 3,000 or less, the mode is switched to the mode of controlling the transfer voltage for forming an image in an image formation region. Specifically, the transfer voltage for forming an image in an image formation region is set to 700 V. No patch image is formed in an inter-image region.

In the case where the number of sheets to be printed is 3,001 or more and 10,000 or less, the mode is switched to the mode of controlling the transfer voltage for forming an image in an image formation region and a patch image. Specifically, the transfer voltage for the image formation region is set to 700 V and the transfer voltage for forming a patch image in an inter-image region is set to 900 V.

In the case where the number of sheets to be printed is more than 10,000, the mode is switched to the mode of controlling the transfer voltage for forming a patch image. Specifically, the transfer voltage for the image formation region is set to a standard voltage of 500 V and the transfer voltage for forming a patch image in an inter-image region is set to 900 V.

Table 12 shows the relation.

TABLE 12

| area ratio in image formation region | number of sheets to be printed | transfer voltage: image portion | transfer voltage: parch image portion |
|---|---|---|---|
| 1% | 1000 or less | 500 V | not formed |
| | 3000 or less | 700 V | not formed |
| | 10000 or less | 700 V | 900 V |
| | more than 10000 | 500 V | 900 V |
| 3% | 2000 or less | 500 V | not formed |
| | 10000 or less | 700 V | not formed |
| | more than 10000 | 500 V | 900 V |

For a larger number of sheets to be printed, the influence of the area ratio of the patch image is larger while the influence of the area ratio in the image formation region is smaller. Therefore, the transfer voltage set to 500 V does not have a significant influence on the amount of the required patch image. In contrast, if a high transfer voltage is kept applied, the flowing current may promote degradation of intermediate transfer medium 6 or transfer roller 9. It is therefore desired that the transfer voltage is lower. Thus, in the case where the number of sheets to be printed is large, the transfer voltage for forming an image in the image formation region is not set high, to thereby enable the durability of the parts of the apparatus to be improved.

In the case where the area ratio in the image formation region is changed, modes which are optimum for respective area ratios may be combined.

For example, a case will be described where an image with an area ratio of 3% is to be formed in an image formation region.

In the case where the number of sheets to be printed is 2,000 or less, there is no concern about granular noise. Therefore, the transfer voltage for the image formation region is set to a standard voltage of 500 V and no patch image is formed in an inter-image region.

In the case where the number of sheets to be printed is 2,001 or more and 10,000 or less, the mode is switched to the mode of controlling the transfer voltage for forming the image in the image formation region. Specifically, the transfer voltage for forming the image in the image formation region is set to 700 V. No patch image is formed in an inter-image region.

In the case where the number of sheets to be printed is more than 10,000, a switch is made to the mode of controlling the transfer voltage for forming a patch image. Specifically, the transfer voltage for the image formation region is set to a standard voltage of 500 V and the transfer voltage for forming a patch image in an inter-image region is set to 900 V.

Thus, in the case where an image with a low area ratio is to be printed, the image formation control device causes a patch image to be formed and the image formation control device instructs transfer control device 8 to switch the mode depending on the number of sheets to be printed. Accordingly, granular noise can effectively be suppressed.

<Other Embodiments>

The relation between the area ratio of an image in an image formation region and the number of printed sheets as illustrated above regarding Examples 1 to 5 each may be stored in the form of a table in a memory (storage means). When an image pattern (area ratio) to be printed and the number of sheets on which the image pattern is to be printed are input, the transfer voltage for forming the image in an image formation region, whether to form a patch image or not, and the transfer voltage for forming a patch image may be set based on the table stored in the memory.

When printing of the aforementioned image pattern is completed and an image pattern to be printed next and the number of sheets on which the image pattern is to be printed are input, the transfer voltage for forming the image in an image formation region, whether to form a patch image or not, and the transfer voltage for forming a patch image may be set in consideration of the information about the preceding printing (by adding the information) if (the area ratio of) the image pattern to be printed next is small.

The present example is described above regarding the case where the relation between the area ratio of a required patch image and the granular noise is evaluated based on predetermined conditions. Depending on the type and the amount of the added lubricant, the area ratio of a required patch image varies. Thus, those skilled in the art can appropriately change the design of the area ratio of the patch image.

An appropriate value of the transfer voltage also varies depending on the resistance of the intermediate transfer medium or transfer roller 9. Thus, those skilled in the art can appropriately change the design of the value of the transfer voltage.

While the present example is described above regarding the case where the intermediate transfer medium is used, the present example is applicable as well to the case where transfer is done directly from the photoreceptor to a recording material (such as paper).

In this case, a member for transferring a toner image from an image formation region on the photoreceptor to an image formation region on the recording material is necessary. The member may be a transfer roller or a conveyer belt.

When an image with a low area ratio is to be printed, the transfer voltage is set higher than that when an ordinary image is to be printed, as done in accordance with the system of the present embodiment.

The amount of the lubricant separated from the toner in the transfer process increases and accordingly the amount of the lubricant supplied to and held on the photoreceptor increases. Thus, decrease of the lubricant on the photoreceptor is alleviated. Accordingly, the frequency at which the patch image is formed is reduced and thereby the consumption of the toner can be reduced.

In the case where an image with a low area ratio is to be printed, the transfer voltage for transferring a patch image formed in an inter-image region is set higher than that for printing an ordinary image.

The transfer voltage for transferring the patch image is thus set higher to increase the amount of the lubricant separated from the toner in the transfer process and thereby increase the amount of the lubricant held on the photoreceptor. Accordingly, with a smaller patch image, the amount of the lubricant on the photoreceptor can be increased. Moreover, the frequency at which the patch image is formed is reduced and thereby the consumption of the toner can be reduced.

If the transfer voltage is set still higher, discharge or the like may occur to degrade the image quality. Therefore, in the case where an ordinary image is to be printed, the value to which the transfer voltage is set has an upper limit. In contrast, in the case where a patch image is to be transferred, it is unnecessary to take the image quality into consideration, and thus the transfer voltage is set higher than that for printing an ordinary image. The transfer voltage which is set higher causes an increased amount of the lubricant to be separated from the toner. Thus, with a smaller patch image, the amount of the lubricant on the photoreceptor can be increased.

Moreover, the frequency at which the patch image is formed is reduced and thereby the consumption of the toner can be reduced.

While the present example has been described regarding the case where a patch image in the shape of a lateral strip is formed, the patch image is not particularly limited to this. A patch image can be formed at any location in the axial direction of the photoreceptor. Therefore, the amount of the lubricant on the photoreceptor can also be corrected depending on the position.

When an image with a low area ratio is to be printed and the number of sheets on which the image is to be printed is small, the transfer voltage for forming the image is set higher than the transfer voltage for forming an ordinary image. When the number of sheets on which the image is to be printed is large, a patch image can be formed in an inter-image region and the transfer voltage for forming the patch image can be set higher than the transfer voltage for forming an ordinary image. In the case where the number of sheets on which the image is to be printed is small, it is unnecessary to form the patch image. The frequency at which the patch image is formed can thus be reduced and thereby the consumption of the toner can be reduced.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image forming apparatus comprising:

a latent image carrier;

an image forming unit configured to form, on the latent image carrier, a toner image using a developer including a toner and a lubricating external additive charged with an opposite polarity to a charge polarity of the toner;

a transfer device configured to electrostatically transfer, at a transfer position, the toner image formed by the image forming unit to a transfer medium;

a cleaning device configured to remove the toner remaining on the latent image carrier after passing the transfer position; and a controller that controls an amount of the lubricating external additive remaining on the latent image carrier immediately after the toner image is transferred to the transfer medium by modulating a transfer voltage applied at the transfer position, based on an area ratio of an image to be printed.

2. The image forming apparatus according to claim 1, wherein the controller is configured to control the transfer voltage applied at the transfer position, based on the area ratio of the image to be printed and a number of sheets on which the image is to be printed.

3. The image forming apparatus according to claim 2, wherein the controller is configured to control the transfer voltage for forming a toner image in a region other than an image region, based on the area ratio of the image to be printed and the number of sheets on which the image is to be printed.

4. The image forming apparatus according to claim 2, wherein the controller is configured to change the transfer voltage for forming a toner image in an image region and the transfer voltage for forming a toner image in a region other than the image region, based on the area ratio of the image to be printed and the number of sheets on which the image is to be printed.

5. The image forming apparatus according to claim 2, wherein the controller is configured to switch among a mode of controlling the transfer voltage for forming a toner image in an image region, a mode of controlling the transfer voltage for forming a toner image in a region other than the image region, and a mode of controlling the transfer voltage for forming a toner image in the image region and a toner image in a region other than the image region, based on the area ratio of the image to be printed and the number of sheets on which the image is to be printed.

6. The image forming apparatus according to claim 1, wherein the controller is configured to control at least one of the transfer voltage for forming a toner image in an image region and the transfer voltage for forming a toner image in a region other than the image region, by referring to a transfer table recorded in advance, based on the area ratio of the image to be printed and a number of sheets on which the image is to be printed.

7. The image forming apparatus according to claim 1, wherein the controller is configured to set the transfer voltage applied at the transfer position higher than a predetermined transfer voltage, when the area ratio of an image to be printed is lower than a predetermined ratio.

8. The image forming apparatus according to claim 1, wherein the lubricating external additive has a particle size smaller than at least a particle size of the toner.

9. A method for controlling an image forming apparatus, the method comprising:

forming a toner image on a latent image carrier using a developer including a toner and a lubricating external additive charged with an opposite polarity to a charge polarity of the toner;

electrostatically transferring, at a transfer position, the formed toner image to a transfer medium;

removing the toner remaining on the latent image carrier after passing the transfer position; and controlling an amount of the lubricating external additive remaining on the latent image carrier immediately after the toner image is transferred to the transfer medium by modulating a transfer voltage applied at the transfer position, based on an area ratio of an image to be printed.

10. The method according to claim 9, wherein the controlling controls the transfer voltage applied at the transfer position based on the area ratio of the image to be printed and a number of sheets on which the image is to be printed.

11. The method according to claim 10, wherein the controlling controls the transfer voltage for forming a toner image in a region other than an image region based on the area ratio of the image to be printed and the number of sheets on which the image is to be printed.

12. The method according to claim 10, wherein the controlling changes the transfer voltage for forming a toner image in an image region and the transfer voltage for forming a toner image in a region other than the image region, based on the area ratio of the image to be printed and the number of sheets on which the image is to be printed.

13. The method according to claim 10, wherein the controlling switches among a mode of controlling the transfer voltage for forming a toner image in an image region, a mode of controlling the transfer voltage for forming a toner image in a region other than the image region, and a mode of controlling the transfer voltage for forming a toner image in the image region and a toner image in a region other than the image region, based on the area ratio of the image to be printed and the number of sheets on which the image is to be printed.

14. The method according to claim 9, wherein the controlling controls at least one of the transfer voltage for forming a toner image in an image region and the transfer voltage for forming a toner image in a region other than the image region, by referring to a transfer table recorded in advance, based on the area ratio of the image to be printed and a number of sheets on which the image is to be printed.

15. The method according to claim 9, wherein the controlling sets the transfer voltage applied at the transfer position higher than a predetermined transfer voltage, when the area ratio of an image to be printed is lower than a predetermined ratio.

16. The method according to claim 9, wherein the lubricating external additive has a particle size smaller than at least a particle size of the toner.

17. A non-transitory storage medium encoded with a computer readable program executable by a computer of an image forming apparatus to cause the computer to perform control of functions comprising:

forming a toner image on a latent image carrier using a developer including a toner and a lubricating external additive charged with an opposite polarity to a charge polarity of the toner;

electrostatically transferring, at a transfer position, the formed toner image to a transfer medium;

removing the toner remaining on the latent image carrier after passing the transfer position; and controlling an amount of the lubricating external additive remaining on the latent image carrier immediately after the toner image is transferred to the transfer medium by modulating a transfer voltage applied at the transfer position, based on an area ratio of an image to be printed.

18. The non-transitory storage medium according to claim 17, wherein the controlling controls the transfer voltage applied at the transfer position, based on the area ratio of the image to be printed and a number of sheets on which the image is to be printed.

19. The non-transitory storage medium according to claim 18, wherein the controlling controls the transfer voltage for forming a toner image in a region other than an image region, based on the area ratio of the image to be printed and the number of sheets on which the image is to be printed.

20. The non-transitory storage medium according to claim 18, wherein the controlling changes the transfer voltage for forming a toner image in an image region and the transfer voltage for forming a toner image in a region other than the image region, based on the area ratio of the image to be printed and the number of sheets on which the image is to be printed.

21. The non-transitory storage medium according to claim 18, wherein the controlling switches among a mode of controlling the transfer voltage for forming a toner image in an image region, a mode of controlling the transfer voltage for forming a toner image in a region other than the image region, and a mode of controlling the transfer voltage for forming a toner image in the image region and a toner image in a region other than the image region, based on the area ratio of the image to be printed and the number of sheets on which the image is to be printed.

22. The non-transitory storage medium according to claim 17, wherein the controlling controls at least one of the transfer voltage for forming a toner image in an image region and the transfer voltage for forming a toner image in a region other than the image region, by referring to a transfer table recorded in advance, based on the area ratio of the image to be printed and a number of sheets on which the image is to be printed.

23. The non-transitory storage medium according to claim 17, wherein the controlling sets the transfer voltage applied at the transfer position higher than a predetermined transfer voltage, when the area ratio of an image to be printed is lower than a predetermined ratio.

24. The non-transitory storage medium according to claim 17, wherein the lubricating external additive has a particle size smaller than at least a particle size of the toner.

* * * * *